US007300309B2

(12) United States Patent
Montena

(10) Patent No.: US 7,300,309 B2
(45) Date of Patent: Nov. 27, 2007

(54) COMPRESSION CONNECTOR AND METHOD OF USE

(75) Inventor: Noah P. Montena, Syracuse, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 11/424,646

(22) Filed: Jun. 16, 2006

(65) Prior Publication Data

US 2006/0223367 A1 Oct. 5, 2006

Related U.S. Application Data

(63) Continuation of application No. 10/991,886, filed on Nov. 18, 2004.

(51) Int. Cl.
*H01R 9/05* (2006.01)

(52) U.S. Cl. ..... 439/578

(58) Field of Classification Search ..... 439/578, 439/462, 460, 583, 584
See application file for complete search history.

(56) References Cited

U.S. PATENT DOCUMENTS

| | | | | |
|---|---|---|---|---|
| 3,744,007 | A | 7/1973 | Horak | |
| 4,739,126 | A | 4/1988 | Gutter et al. | |
| 5,011,432 | A * | 4/1991 | Sucht et al. | 439/584 |
| 5,066,248 | A | 11/1991 | Gaver, Jr. et al. | |
| 5,456,611 | A | 10/1995 | Henry et al. | |
| 5,620,339 | A * | 4/1997 | Gray et al. | 439/578 |
| 5,993,253 | A * | 11/1999 | Sai | 439/578 |
| 6,033,260 | A * | 3/2000 | Murata et al. | 439/578 |
| 6,089,912 | A * | 7/2000 | Tallis et al. | 439/584 |
| 6,153,830 | A * | 11/2000 | Montena | 174/88 C |
| 6,174,206 | B1 * | 1/2001 | Yentile et al. | 439/638 |
| 6,241,553 | B1 * | 6/2001 | Hsia | 439/578 |
| 6,309,251 | B1 * | 10/2001 | Tang | 439/584 |
| 6,331,123 | B1 * | 12/2001 | Rodrigues | 439/584 |
| 6,517,379 | B2 | 2/2003 | Leve | |
| 6,575,784 | B1 * | 6/2003 | Yamada | 439/578 |
| 6,575,786 | B1 * | 6/2003 | Khemakhem et al. | 439/580 |
| 6,619,876 | B2 * | 9/2003 | Vaitkus et al. | 403/349 |
| 6,648,674 | B1 * | 11/2003 | Dobler | 439/460 |
| 6,648,683 | B2 * | 11/2003 | Youtsey | 439/578 |
| 6,705,875 | B2 | 3/2004 | Berghorn et al. | |
| 6,776,657 | B1 * | 8/2004 | Hung | 439/578 |
| 2002/0119699 | A1 | 8/2002 | Leve | |
| 2002/0142625 | A1 | 10/2002 | Berghorn et al. | |

FOREIGN PATENT DOCUMENTS

GB 2264400 A * 8/1993

* cited by examiner

*Primary Examiner*—Tulsidas C. Patel
*Assistant Examiner*—Vladimir Imas
(74) *Attorney, Agent, or Firm*—Schmeiser, Olsen & Watts

(57) ABSTRACT

A compression connector for coupling an end of a coaxial cable and method of use is discussed. The connector includes a post, configured to be inserted into an end of the coaxial cable around the dielectric and under the protective outer jacket thereof. The device further includes a connector body, operatively positioned with respect to the post and including a plurality of closeable fingers, a fastener member, slidably receivable with respect to the connector body for closing the closeable fingers and for securing, in both directions, axial movement of the fastener member with respect to the connector body, an outer compression sleeve, and a threaded nut, engageable with the outer compression sleeve for securely coupling the hand installable compression connector to a coaxial cable interface port. An advantage of this connector is installation without the need for specialized tools.

10 Claims, 7 Drawing Sheets

COMPRESSION CONNECTOR AND METHOD OF USE

This application is a continuation of application Ser. No. 10/991,886, filed on Nov. 18, 2004, currently pending.

BACKGROUND OF INVENTION

1. Technical Field

This invention relates generally to the field of connectors for coaxial cables. More particularly, this invention provides for a compression connector and method of use.

2. Related Art

Broadband communications have become an increasingly prevalent form of electromagnetic information exchange and coaxial cables are common conduits for transmission of broadband communications. Connectors for coaxial cables are typically threaded onto a complementary coaxial cable interface port to electrically integrate coaxial cables to various electronic devices.

Connectors are generally fixed to coaxial cables by specialized force multiplying tools which crimp or compress the connectors onto the cables. Such crimp tooling is often not adaptable for use with different sizes of connector bodies. Moreover, specialized force multiplying tools may be too costly for an average home installer to justify purchasing if the home installer is only installing a small number of connectors to coaxial cables.

Accordingly, there is a need in the field of coaxial cable connectors for an improved connector design.

SUMMARY OF INVENTION

The present invention provides an apparatus for use with coaxial cable connections that offers improved reliability.

A first general aspect of the invention provides a connector for coupling an end of a coaxial cable to a coaxial interface port, the coaxial cable having a center conductor surrounded by a dielectric, the dielectric being surrounded by a conductive shield and a protective outer jacket, said connector comprising a connector body having a first end and a second end, the first end configured to be mounted to the coaxial interface port, and the second end having a plurality of closeable fingers for receiving the coaxial cable, said plurality of closeable fingers having an open position and a closed position, and a fastener member operating with a compression sleeve, wherein the fastener member and compression sleeve are slidably attached to the connector body in a first position where the plurality of closeable fingers are in the open position, and wherein at least one of said connector body and said fastener member includes a surface feature to secure axial movement in both directions of said fastener member with respect to said connector body when the fastener member and compression sleeve are moved to a second position causing the closeable fingers to compress into a closed position securely engaging the coaxial cable.

A second general aspect of the invention provides a connector for coupling an end of a coaxial cable to a coaxial interface port, the coaxial cable having a center conductor surrounded by a dielectric, the dielectric being surrounded by a conductive shield and a protective outer jacket, said connector comprising, a post, configured to be inserted into an end of the coaxial cable around the dielectric and under the protective outer jacket thereof, a connector body, operatively positioned with respect to said post, said connector body having a plurality of closeable fingers, and a threaded nut, operatively positioned with respect to said connector body.

A third general aspect of the invention provides a connector for coupling an end of a coaxial cable, the coaxial cable having a center conductor surrounded by a dielectric, the dielectric being surrounded by conductive shield and a protective outer jacket, said connector comprising a post, configured to be inserted into an end of the coaxial cable around the dielectric and under the protective outer jacket thereof, a connector body, operatively positioned with respect to said post, said connector body having a plurality of closeable fingers, and an outer compression sleeve, operatively positioned with respect to said connector body and configured to engage a threaded nut.

A fourth general aspect of the invention provides a connector for coupling an end of a coaxial cable, the coaxial cable having a center conductor surrounded by a dielectric, the dielectric being surrounded by a conductive shield and protective outer jacket, said connector comprising a connector body, wherein said connector body includes, a plurality of closeable fingers extending from an exterior casing, and an integral interior post member, said post member configured to be inserted into an end of the coaxial cable around the dielectric and under the conductive shield and protective outer jacket thereof.

A fifth general aspect of the invention provides a push-on-type connector for coupling an end of a coaxial cable to a coaxial interface port, said connector comprising a connector body having a first end and a second end, the first end configured to be pushed on to the coaxial interface port, and the second end having a plurality of closeable fingers for receiving the coaxial cable, said plurality of closeable fingers having an open position and a closed position, and a fastener member, wherein the fastener member is slidably attached to the connector body in a first position where the plurality of closeable fingers are in the open position, and wherein at least one of said connector body and said fastener member includes a surface feature to secure axial movement in both directions of said fastener member with respect to said connector body when the fastener member is moved to a second position causing the closeable fingers to compress into a closed position securely engaging the coaxial cable.

A sixth general aspect of the invention provides a connector for coupling an end of a coaxial cable, the coaxial cable having a center conductor surrounded by a dielectric, the dielectric being surrounded by a conductive shield and protective outer jacket, said connector comprising a connector body having a first end and a second end, the first end configured to be mounted to the coaxial interface port, and the second end having a plurality of closeable fingers for receiving the coaxial cable, wherein at least one closeable finger includes an exterior surface feature, a fastener member, configured to achieve purchase with the exterior surface feature, and means for securely affixing the coaxial cable to the connector body.

A seventh general aspect of the invention provides a method for coupling a connector and a coaxial cable, said method comprising preparing a coaxial cable, providing a hand installable compression connector in a first initially assembled position, inserting the coaxial cable into the connector, and securing the connector by hand to the cable by moving an outer compression sleeve in cooperation with a fastener member thereby compressing closeable fingers of a connector body against the cable to retain the cable axially when the fastener member moves into a final mechanically secured position.

The foregoing and other features of the invention will be apparent from the following more particular description of various embodiments of the invention.

BRIEF DESCRIPTION OF THE DRAWINGS

Some of the embodiments of this invention will be described in detail, with reference to the following figures, wherein like designations denote like members, wherein.

DETAILED DESCRIPTION OF THE INVENTION

Figure 1:
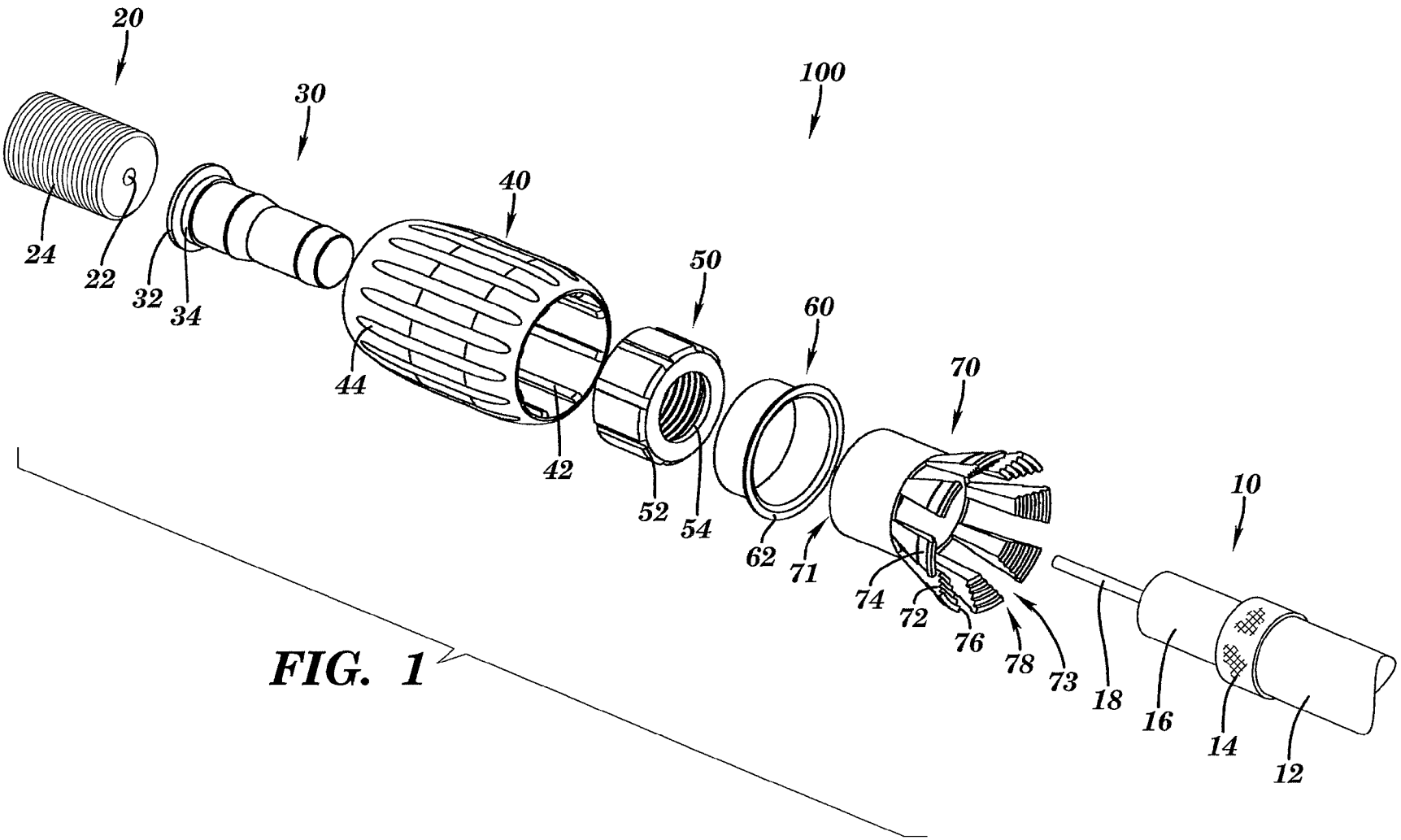
FIG. 1 depicts an exploded, perspective view of an embodiment of a compression connector, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Referring to the drawings, FIG. 1 depicts one embodiment of a compression connector 100. The connector 100 may include a coaxial cable 10 having a protective outer jacket 12, a conductive shield 14, an interior dielectric 16 and a center conductor 18. The coaxial cable 10 may be prepared as embodied in FIG. 1 by removing the protective outer jacket 12 and drawing back the conductive shield 14 to expose a portion of the interior dielectric 16. Further preparation of the embodied coaxial cable 10 may include stripping the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. The dielectric 16 may be comprised of materials suitable for electrical insulation. It should be noted that the various materials of which all the various components of the coaxial cable 10 are comprised should have some degree of elasticity that allows the cable 10 to flex or bend in accordance with traditional broadband communications standards, installation methods and/or equipment. It should further be recognized that the radial thickness of the coaxial cable 10, protective outer jacket 12, conductive shield 14, interior dielectric 16 and/or center conductor 18 may vary based upon generally recognized parameters corresponding to broadband communication standards and/or equipment.

Referring further to FIG. 1, the connector 100 may also include a coaxial cable interface port 20. The coaxial cable interface port 20 includes a conductive receptacle 22 for receiving a portion of a coaxial cable center conductor 18 sufficient to make adequate electrical contact. The coaxial cable interface port 20 may further comprise a threaded exterior surface 24. Nevertheless, various embodiments may employ a smooth surface or surface having other features such as knurling or strategic protrusions for receiving a compression connector 100. It should be recognized that the radial thickness and or the length of the coaxial cable interface port 20 and/or the conductive receptacle 22 may vary based upon generally recognized parameters corresponding to broadband communication standards and/or equipment. Moreover, the pitch and height of threads which may be formed upon the threaded exterior surface 24 of the coaxial cable interface port 20 may also vary based upon generally recognized parameters corresponding to broadband communication standards and/or equipment. The coaxial cable interface port 20 may also be formed of materials that facilitate electrical grounding through the connector 100. Those skilled in the relevant art should recognize that the coaxial cable interface port 20 may be any port capable of connecting with compression connectors 100. Accordingly, coaxial cable interface ports 20 may comprise ports on electrical components such as televisions, video cassette recorders, digital video disk players, computers, modems, stereo systems, satellite systems, CCTV systems, network components, or other electrical devices for facilitating broadband communications. Moreover, the coaxial cable interface port 20 may be the connecting interface on a transmission splitter, or signal multiplexing device, or other device for modifying and/or assisting broadband communications via a coaxial cable 10.

Referring still further to FIG. 1, an embodiment of the compression connector 100 may comprise a post 30. The post 30 may be formed of metals or plastics or other materials that would facilitate a rigidly formed body. Additionally, the materials from which the post 30 is formed may be either conductive or non-conductive, depending upon whether the post 30 is utilized to facilitate grounding and electromagnetic noise reduction through the compression connector 100. Manufacture of the post 30 may include casting, extruding, cutting, turning, drilling, injection molding, blow molding, or other fabrication methods that may provide efficient production of the component. The post 30 may have a flange 32 extending outward from one end of the post 30. Additionally, an embodiment of the post 30 may include a ridge 34 that may abut the flange 32 and protrude radially from the unbroken surface of the post 30. The post 30 should be formed such that portions of a prepared coaxial cable 10 including the dielectric 16 and center conductor 18 may pass axially into and/or through the body of the post 30. Moreover, the post 30 should be dimensioned such that a portion of the exterior surface of the post 30 may be inserted into an end of the prepared coaxial cable 10, around the dielectric 16 and under the conductive shield 14 and protective outer jacket 12. Accordingly, an embodiment of the post 30 formed of conductive material may be inserted into an end of the prepared coaxial cable 10 under the drawn back conductive shield 14 thereby making electrical contact with the conductive shield 14 facilitating grounding through the compression connector 100.

In additional reference to FIG. 1, the compression connector 100 may comprise an outer casing, shell or compression sleeve 40 having internal surface features 42 such as axially directional splines, slots, ridges, bumps, dimple patterns or hexagonal flat surfaces formed on the interior surface of the outer compression sleeve 40. The outer casing, shell or compression sleeve 40 may further comprise exterior surface features 44 such as textured grooves, protrusions or knurling formed on the exterior surface of the outer compression sleeve 40. It should be noted that the outer casing, shell or compression sleeve 40 may be manufactured of materials such as metals, polymers, composites and the like. Furthermore, the outer casing, shell or compression sleeve 40 may be fabricated via casting, extruding, cutting, turning, drilling, injection molding, blow molding, and/or other fabrication methods that may provide efficient production of the component. Moreover, the outer casing, shell or compression sleeve 40 may be formed such that it is radially the outermost component of the compression connector 100.

With further reference to FIG. 1, the compression connector 100 may comprise a threaded nut 50 for securely coupling the compression connector 100 to the coaxial cable interface port 20. The threaded nut 50 may comprise exterior surface features 52 such as axially directional slots, splines, ridges, bumps, dimple patterns or hexagonal flat surfaces formed upon the exterior surface of the threaded nut 50. The threaded nut 50 may also comprise a protrusion or lip 54 formed on an edge of the threaded interior surface of the threaded nut 50. The threaded nut 50 may be made of materials such as metals, polymers, composites and the like. Moreover, the threaded nut 50 may be formed by casting, extruding, cutting, turning, drilling, injection molding, threading, or other methods that may provide efficient production of the component. In an embodiment of the compression connector 100, the threaded nut 50 may be a standard off-the-shelf hexagonal nut having hexagonal flat surfaces that is integrated into the particularly embodied design.

As shown further still in FIG. 1, the compression connector 100 may comprise a fastener member 60. The fastener member 60 may be a ring, pipe section, or other cylindrical-like shape having a central axial bore. In one embodiment, the fastener member 60 may have a flanged edge 62. The flanged edge 62 may be formed such that it extends from the fastener member 60 with a slight taper. In another embodiment the flanged edge 62 may radially extend perpendicularly from the exterior surface of the fastener member 60. In still other embodiments, the flanged edge 62 may include both a tapered portion and a perpendicularly extending portion. Various other embodiments of the fastener member 60 may employ features such as protrusions, dimples, slots, and/or the like that may operate to engage a compression sleeve 40. It should be recognized, by those skilled in the requisite art, that the fastener member 60 may be formed of materials such as metals, polymers, composites and the like. Furthermore, the fastener member 60 may be manufactured via casting, extruding, cutting, turning, drilling, injection molding, blow molding, or other fabrication methods that may provide efficient production of the component.

With continued reference to FIG. 1, the compression connector 100 may comprise a connector body 70. The connector body 70 may have a first end 71 and opposing second end 73. The first end may be configured to be mounted to a coaxial cable interface port 20. In various embodiments, the mounting configuration may include geometric designs allowing for the operable attachment of a threaded nut 50, wherein the nut 50 may then be threaded onto a coaxial cable interface port 20. However, in various other embodiments, the mounting configuration may involve geometric designs of the first end 71 intended to provide a frictional, tolerance fit on a coaxial cable interface port 20. The second end 73 of the connector body 70 may include closeable fingers 72. The closeable fingers 72 may be formed of compliant material allowing the closeable fingers 72 to have a static posture in an open position 78 and the dynamic ability to bend and close inward. However, it should be understood that the closeable fingers 72 may also be formed of rigid material wherein finger closure may occur via assistance from a hinged spring or other implement allowing the closeable fingers 72 to resistantly close inward from the static open position 78. The closeable fingers 72 may have interior surface features 76 such as axial serrations, dimples or knurling for allowing the closeable fingers 72 to securely engage the prepared coaxial cable 10. The closeable fingers may also comprise an exterior surface feature 74 which may be embodied as a shallow exterior recess formed on the surface of the closeable fingers 72 into which the fastener member 60 may be slidably and securely disposed. Various other embodiments may employ difference surface features such as protrusions, dimples, slots, and/or the like that may operate to achieve purchase with a fastener member 60. The exterior surface feature 74 may be formed to secure axial movement in both directions of the fastener member 60 with respect to the connector body 70. The connector body 70 may be formed of metals or plastics or other materials that would facilitate a rigidly formed body having bendable fingers 72. Additionally, the materials from which the connector body 70 is formed may be either conductive or non-conductive, depending upon whether the connector body 70 is utilized to facilitate grounding and electromagnetic noise reduction through the compression connector 100. Manufacture of the connector body 70 may include casting, extruding, cutting, turning, drilling, injection molding, blow molding, stamping, bolting, riveting, screwing, gluing or other fabrication methods that may provide efficient production of the component. It should be appreciated, by those skilled in the relevant art, that various embodiments of the exterior surface feature 74 may be employed to secure axial movement. For example, a shallow recess may be formed on the interior surface of the fastener member 60 and the closeable fingers 72 may comprise an exterior ridge or lip that may correspondingly retain movement when moved into position with the shallow recess of the fastener member 60. Moreover, various other surface features such as dimples, knurling, convex/concave surface geometries, holes and/or the like may also be formed upon either of the fastener member 60 and connector body 70 to facilitate secure engagement.

As further shown in the drawings, FIG. 1 depicts means for securely affixing the coaxial cable to the connector body. The connector 100 may include a fastener member 60 configured to operate in conjunction with the outer compression sleeve 40, wherein the outer compression sleeve 40 may be slidably maneuvered, by hand or with the assistance of gripping tools, to act against the fastener member 60 such that the fastener member 60, as acted against and slidably moved, compresses the closeable fingers of connector body 70 against a received coaxial cable 10. The means to securely affix the coaxial cable 10 to the connector body 70 may be an exterior surface feature 74 included on at least one of the closeable fingers 72. Hence, the fastener member 60 may slidably compress the closeable fingers 72 until the fastener member 60 becomes fastened by and achieves purchase with the exterior surface feature 74 of a closeable finger 72 of connector body 70. Further, the connection of the cable 10 may be assisted due to compression applied by the closeable fingers 72 and friction forces created by the axial serrations 76 of the closeable fingers 72 on the coaxial cable 10. The means for affixing the coaxial cable 10 may be utilized when the connector body 70 is securely fastened against the cable 10 by and following operation of the fastener member 60 acting in conjunction with the outer compression sleeve 40 until the fastener member 60 becomes retained by physical interaction with the exterior surface feature 74 on at least one of the closeable fingers 72.

Figure 2:
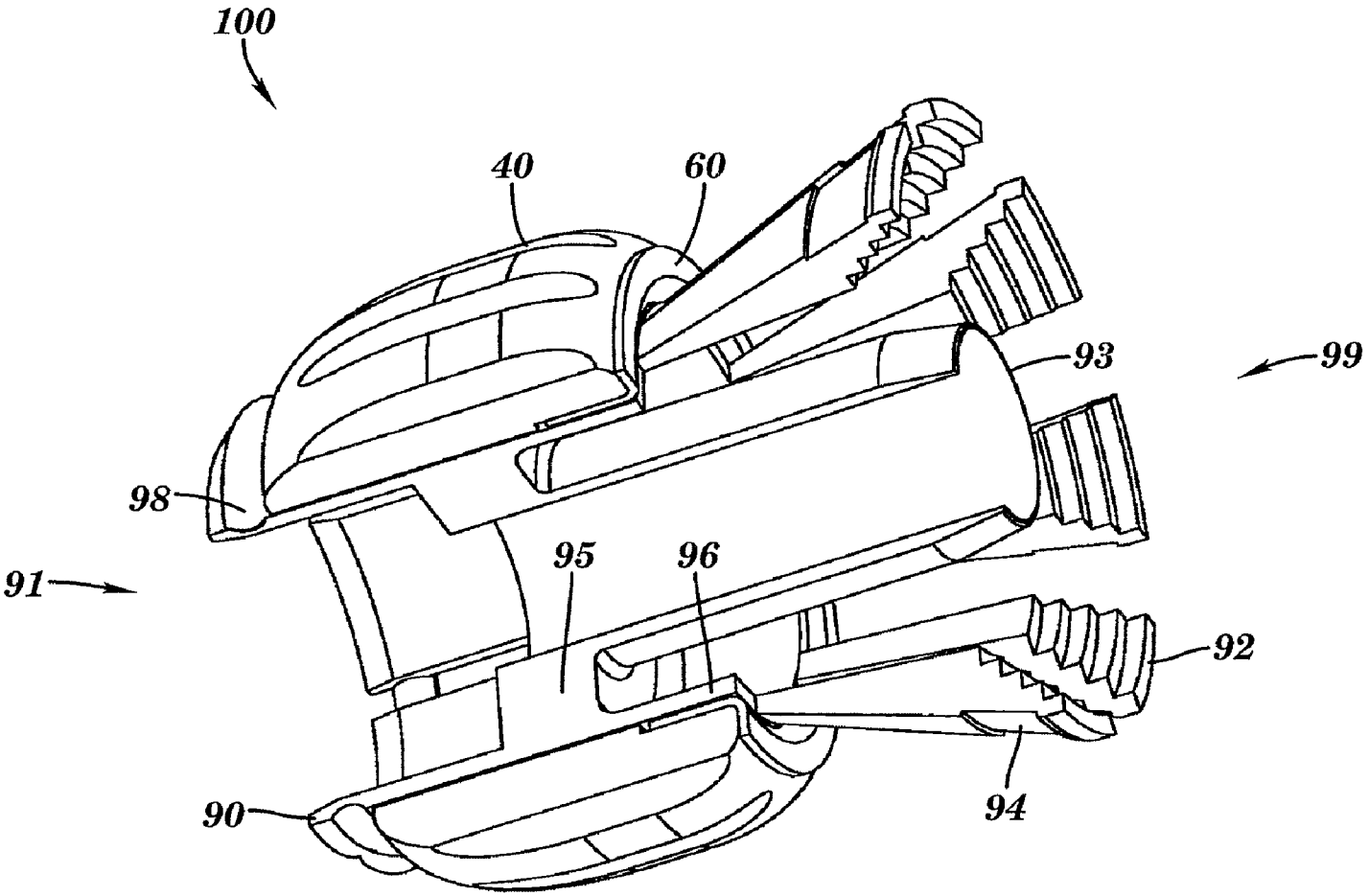
FIG. 2 depicts a rear cut-away perspective view of an embodiment of a compression connector in accordance with the present invention.

With reference to FIG. 2, a rear cut-away perspective view of a compression connector 100 according to the present invention may comprise an embodiment of a connector body 90 that is formed having an integral post member 93 such the integral formation facilitates a single mold, single machined piece, unitary, or single-body structure wherein an interior unifying wall 95 may define and allow for an unbroken surface between an exterior casing 96 of the connector body 90 and the interior post member 93 of the connector body 90. The connector body 90 may include a first end 91 and opposing second end 99. Additionally, the connector body 90 may include closeable fingers 92 extending from the exterior casing 96 at the second end 99 of the connector body 90, wherein the closeable fingers 92 include an exterior surface feature 94. Furthermore, the connector body 90 may work in conjunction with a slidably attached fastener member 60 operating in coincidence with an outer compression sleeve 40 to facilitate the constriction of the closeable fingers 92 into secure engagement with a coaxial cable 10 (shown in FIG. 1), when the fastener member 60 achieves purchase with the surface feature 94. Moreover, the connector body 90 may include an exterior annular detent 98 located proximate the first end 91 of the connector body 90. Several advantages pertain to the integral nature of an incorporated, built in, molded, or unitarily machined structuring of an integral connector body 90 unifying the exterior casing 96 and the interior post member 93. For example, the integral structuring may prevent moisture or other sealing problems between the interior post member 93 and the exterior casing 96 of the connector body 90. Also, utilization of an integral connector body 90 inherently reduces the number of parts required for assembly and formation during manufacture of the compression connector of the present invention. Moreover, where the a unitary connector body 90 is employed having an integral interior wall 95 forming an unbroken surface between the exterior casing 96 and the post member 93, the number of potential ground points between a pulled back conductive shield 14 of a coaxial cable 10 (see FIG. 1) and the connector body 90 of compression connector 100 is increased, thereby facilitating grounding through the connector 110 and reducing electromagnetic noise ingress disruptive of broadband coaxial cable transmissions.

Figure 3:
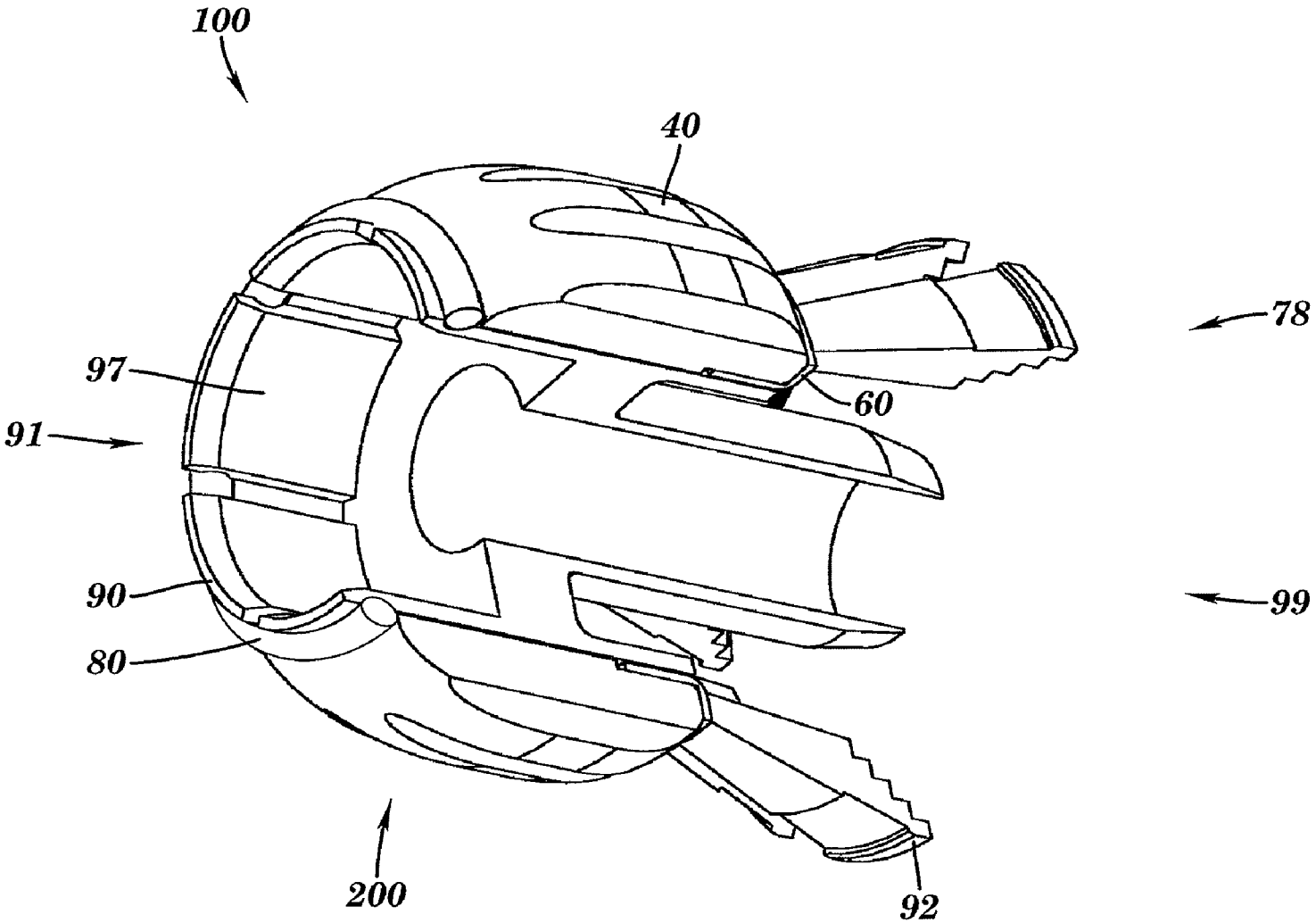
FIG. 3 depicts a front cut-away perspective view of an embodiment of a compression connector in accordance with the present invention.

With continued reference to the drawings, FIG. 3 further depicts, in a front cut-away perspective view, a compression connector 100 including a connector body 90. The first end 91 of connector body 90 may be configured to facilitate mounting of the connector 100 on a coaxial cable interface port 20 (shown in FIG. 1). For example, the internal surface 97 of the first end 91 of connector body 90 may be annularly smooth, allowing the connector 100 to act as a frictional push-on-type end that mates with the interface port 20. However, the internal surface 97 may be configured with features such as dimples, protrusions, knurling, ribs, and/or other like features that may assist in securing push-on-type engagement with a coaxial cable interface port 20. Moreover, the internal surface 97 may include axial directional slots (as shown) or hexagonal flat surfaces, that allow for slidable engagement with a threaded nut 50 (shown in FIG. 1) to facilitate secure mounting on a threaded coaxial cable interface port 20. Still farther, in various other embodiments, the internal surface 97 may be threaded to facilitate mounting on an interface port 20. In addition, the compression connector 100 may include an O-ring 80 useful for maintaining the slidably attached outer compression sleeve 40 and fastener member 60 in a first position 200. In an embodiment of connector 100, the O-ring 80 may reside in the exterior annular detent 98 (shown in FIG. 2) of connector body 90 to prevent the outer compression sleeve 40 and fastener member 60 from slipping off the compression connector 100. While in a first position 200, the closeable fingers 92 at the second end 99 of connector body 90 would be spread in an open position 78.

Figure 4:
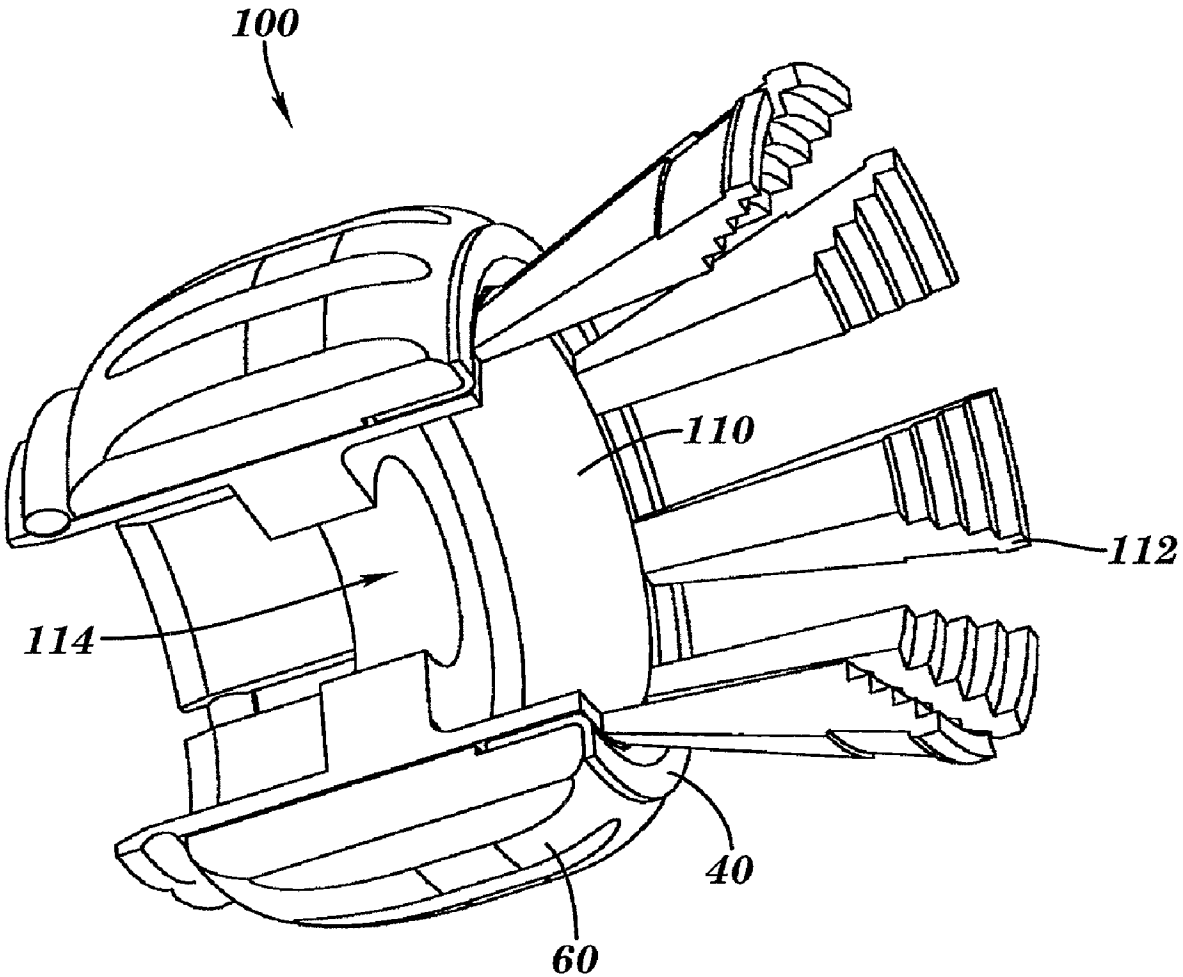
FIG. 4 depicts a cut-away perspective view of an embodiment of a compression connector.

With further reference to the drawings, FIG. 4 depicts a cut-away perspective view of a compression connector 100 having a connector body 110. Notably, this embodiment of compression connector 100 does not include a post (like post 30 shown in FIG. 1) or a connector body having a post member (like post member 93 of connector body 90 shown in FIG. 2). The connector body 110 may include closeable fingers 112, wherein the closeable fingers 112 may compress against and secure a received coaxial cable 10 (shown in FIG. 1) when acted upon by slidable movement of an outer compression sleeve 40 working in conjunction with a fastener member 60. Furthermore, the connector body 110 may include a central axial bore 114 through which portions of the coaxial cable 10 may pass to make physical and electrical contact with a coaxial cable interface port 20 (shown in FIG. 1). The central axial bore may be divided into sections having various diameters, may have one or more angled tapers, or may exist as a single diameter bore. One advantage of not having a post or post member is that users may more easily attach a coaxial cable 10 without having to insert the post or post member under the conductive shield and around the dielectric (shown in FIG. 1). Moreover, the coaxial cable 10 may be prepared by merely exposing a portion of the center conductor 18 without stripping and/or drawing back the protective outer jacket 12 and/or conductive shield 14 (shown in FIG. 1).

Figure 5:
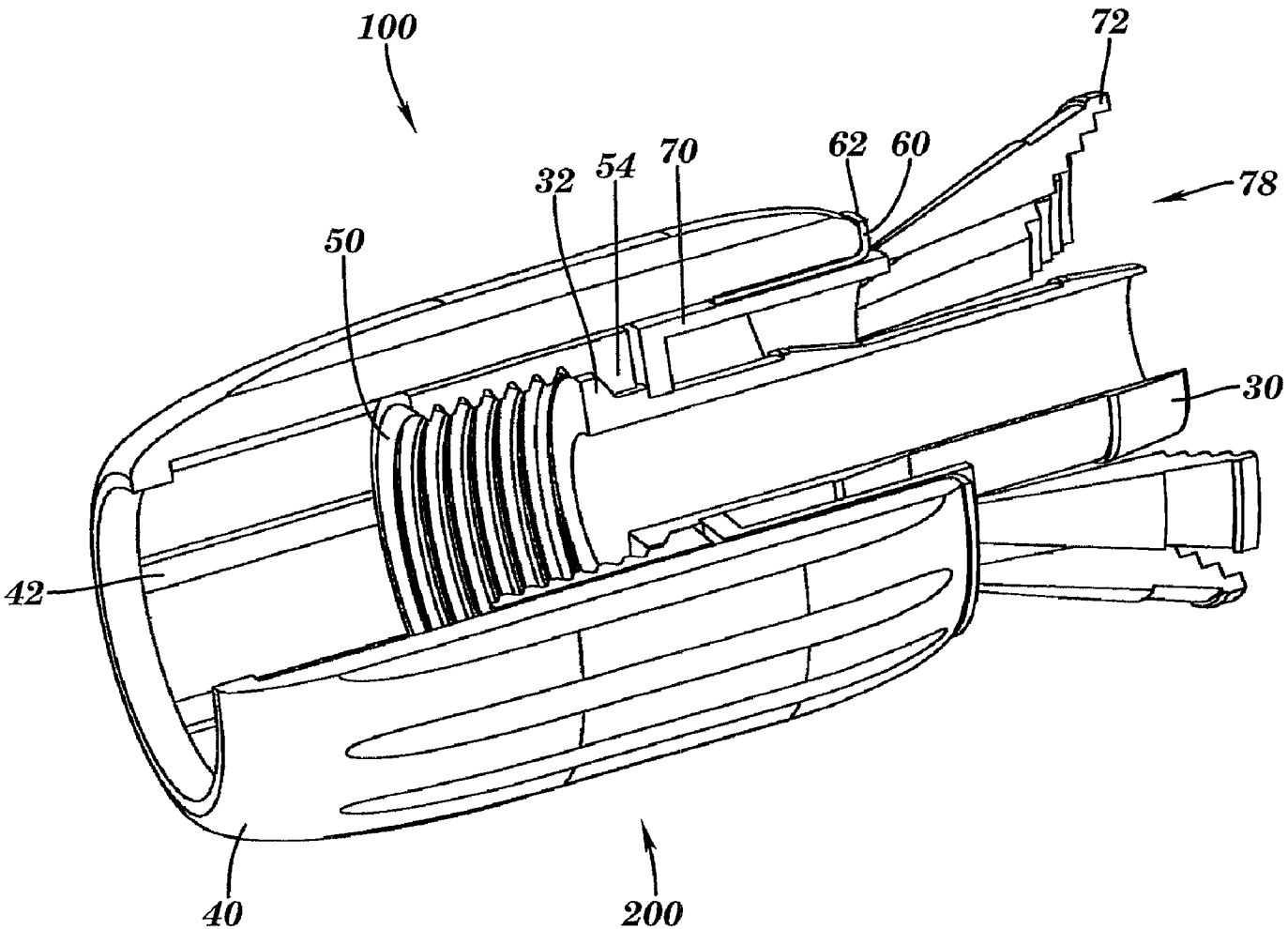
FIG. 5 depicts a cut-away perspective view of an embodiment of a compression connector in a first position with closeable fingers in an open position, in accordance with the present invention; and, FIG. 6 depicts a cut-away perspective view of an embodiment of a compression connector in a second position with closeable fingers in a closed position, in accordance with the present invention.

A method for coupling a compression connector is now described with reference to FIG. 5 which depicts a cut-away perspective view of an embodiment of a compression connector 100 in a first initially assembled position 200 with closeable fingers 72 in an open position 78. A first step of providing a prepared coaxial cable 10 may involve removing the protective outer jacket 12 and drawing back the conductive shield 14 to expose the interior dielectric 16. Further preparation of the embodied coaxial cable 10 may include stripping a portion of the exposed dielectric 16 to expose a portion of the center conductor 18.

Another method step may be providing the compression connector 100 in a first position 200. The compression connector 100 may be initially assembled by axially sliding the fastener member 60 (a ring in one embodiment) around the outer diameter of the connector body 70 until the fastener member 60 just begins to compress the closeable fingers 72 of the connector body 70 thereby retaining the closeable fingers 72 in a static open position 78. The connector body 70 having the fastener member 60 slipped onto it may then be slidably inserted into an end of the outer casing, shell or compression sleeve 40. Where the fastener member 60 is embodied by a ring having a flanged edge 62, the connector body 70 having the fastener member 60 slipped onto it may be inserted into the outer casing, shell or compression sleeve 40 until the end or the outer casing, shell or sleeve 40 abuts the flanged edge 62 of the embodied ring-shaped fastener member 60.

Additional assembly for orienting the compression connector 100 into a first position 200 may be accomplished by insertion of the threaded nut 50 into the end of the outer casing, shell or compression sleeve 40 opposite the end wherein the connector body 70 and fastener member 60 have been slidably inserted until the threaded nut 50 abuts an edge of the connector body 70. In one embodiment, the threaded nut 50 may be inserted such that the edge of the threaded nut 50 comprising a lip 54 formed on the interior surface of the threaded nut 50 is inserted into the outer casing, shell or sleeve 40 such that the lipped edge 54 abuts the edge of the connector body 70. Cooperative slidable engagement of the threaded nut 50 and the outer compression sleeve 40 may be accomplished by aligning the threaded nut 50 such that the exterior surface features 52 such as axially directional slots formed upon the exterior surface of the threaded nut 50 correspond with the interior surface features 42 such as axially directional splines formed on the interior surface of the outer compression casing, shell or sleeve 40. It should be recognized that cooperative slidable engagement of the threaded nut 50 and the outer casing, shell or compression sleeve 40 may also be facilitated by a different embodiment of the threaded nut 50 having exterior surface features such as axial spline and a corresponding different embodiment of the outer casing, shell or sleeve 40 having interior surface features 42 such as axial slots. Moreover, various other surface features such as patterned dimples, or ridges and/or the like may be employed to accomplish cooperative slidable engagement of the threaded nut 50 and the outer compression sleeve 40.

Still further assembly for orienting of one embodiment of a compression connector 100 in a first position 200 may be accomplished by axial insertion of the post 30 into the outer casing, shell or compression sleeve 40 until the flange 32 of the post 30 abuts the lip 54 of the threaded nut 50 and ridge 34 of the post 30 abuts the inserted edge of connector body 70. If an embodiment of the invention includes a unitary post/connector body structure, initial assembly of the components may vary accordingly. For example, the threaded nut 50 may be attached to the integral post/connector body structure. Thus, when assembled, various embodiment of the compression connector 100 may have a portion of the post 30 extending axially beyond the end of the outer casing, shell or sleeve 40, wherein the same portion of the post 30 is radially within the circumference of the closeable fingers 72 of the connector body 70. The closeable fingers 72 may accordingly extend axially beyond the end of the outer casing, shell or compression sleeve 40, said closeable fingers 72 being in an open position 78. Moreover, if an embodiment of a compression connector 100 does not include a threaded nut 50, or if an embodiment does not include a post 30 or post member 93 of a connector body 90, initial orientation and assembly of the compression connector 100 may vary according to the embodied compression connector 100 design as understood by those skilled in the art.

With further reference to the drawings a method for coupling a compression connector is further described with reference to FIG. 6, which depicts a cut-away perspective view of an embodiment of a compression connector 100 in a second position 202 with closeable fingers 72 in a closed position 79. The closed position 79 of the closeable fingers 72 may be accomplished by slidably moving the closeable fingers 72 of the connector body 70 into the outer casing, shell or compression sleeve 40. Such slidable movement may be effectuated by force of hand, wherein a person may grasp and slide the outer casing, shell or compression sleeve 40 toward the closeable fingers 72 of the connector body 70. The person's hand grasp may be assisted by the exterior surface features 44 such as textured grooves formed on the exterior surface of the outer casing, shell or sleeve 40. As the closeable fingers 72 are slidably moved into the outer casing, shell or compression sleeve 40, the fastener member 60, which may be embodied by a ring, may also slidably move along the exterior surface of the closeable fingers 72 due to engagement with the fastener member 60 which abuts the edge of the sliding outer casing, shell or compression sleeve 40. In an embodiment the fastener member 60 may abut the outer casing, shell or sleeve 40 via a surface feature such as a flange 62. It should be recognized that the fastener member 60 may comprise other surface features such as radially extending protrusions, posts, ridges and/or the like that may abut the edge of outer casing, shell or sleeve 40 and thereby facilitate sliding of the fastener member 60 as the outer casing, shell or compression sleeve 40 is slid over the closeable fingers 72 of the connector body 70. The fastener member 60 may be sized such that as it passes over the widely spread closeable fingers 72, from a first position 200 to a second position 202, it reactively draws them inward from an open position 78 to a closed position 79. Additionally, the post 30 may slidably move in conjunction with the connector body 70 because as the connector body 70 is slid into the outer compression sleeve 40 the connector body 70 may engage the post 30 at a location where ridge 34 abuts the inserted edge of the connector body 70 thereby causing to post 30 to correspondingly slide into the outer casing, shell or sleeve 40. Moreover, in one embodiment, the threaded nut 50 may also slide in conjunction with connector body 70 because as the connector body 70 is slid into the outer compression sleeve 40 the connector body 70 may engage the threaded nut 50 at a location where the inserted edge of the connector body 70 abuts the lipped edge 54 of the threaded nut 50 thereby causing the threaded nut 50 to correspondingly slide into the outer casing, shell or sleeve 40. Cooperative slidable engagement of the threaded nut 50 and the outer casing, shell or sleeve 40 may be facilitated by the exterior surface features 52 such as axially directional slots formed upon the exterior surface of the threaded nut sliding in correspondence with the interior surface features 42 such as axially directional splines formed on the interior surface of the outer casing, shell or compression sleeve 40.

Figure 6:
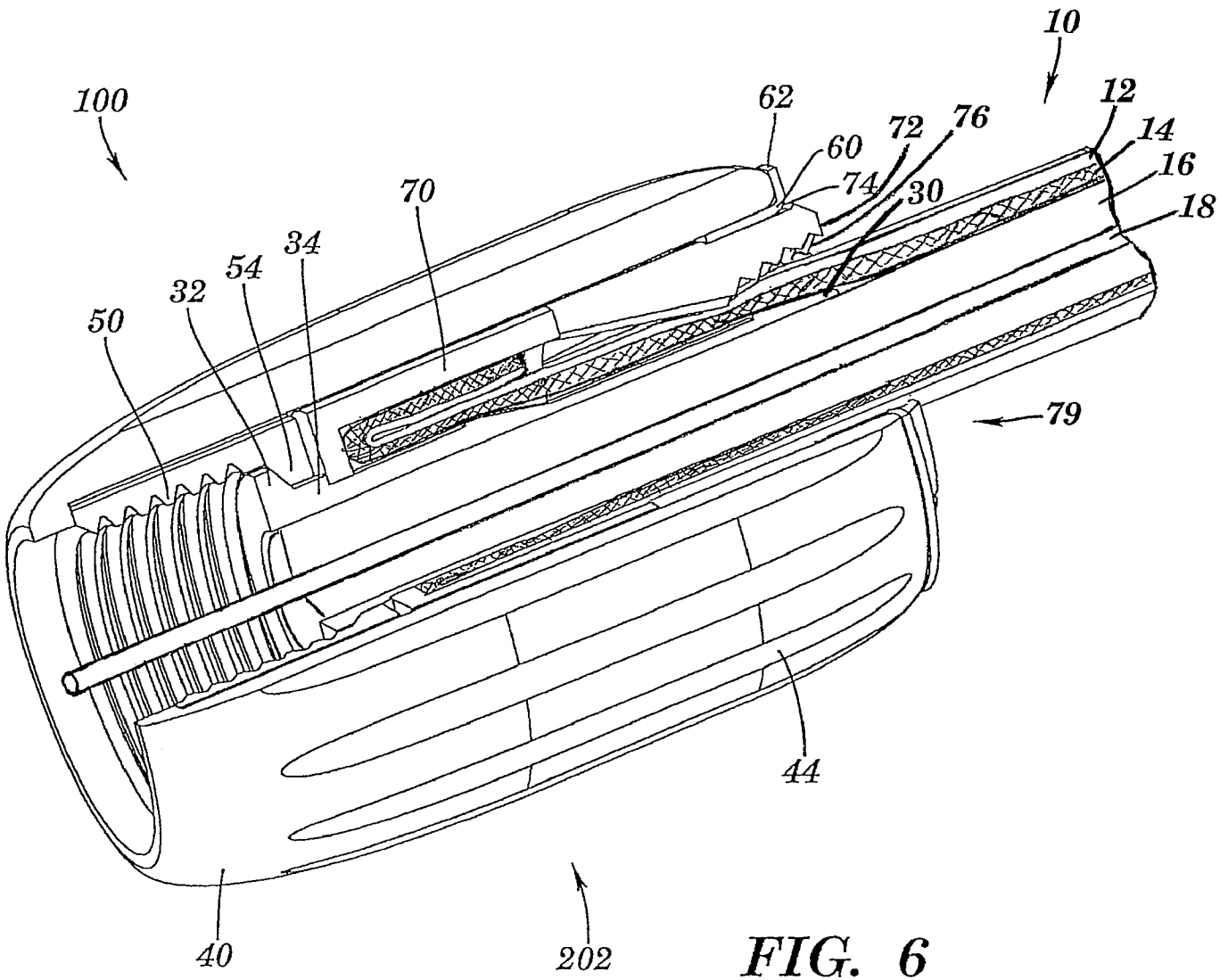

With continued reference to FIG. 6 and additional reference to FIGS. 1-5, a method of coupling a compression connector 100 on an end of a coaxial cable is further described. An embodiment of compression connector 100 provided in a first initially assembled position 200 with closeable fingers 72 in the open position 78, may be terminally installed onto a coaxial cable 10. The compression connector 100 may be attached securely to the coaxial cable 10 simply by firm insertion of the coaxial cable 10 into the compression connector 100. Insertion may be accomplished by hand or through the use of assisting tools and may comprise maneuvering the prepared coaxial cable 10 such that the post 30 is positioned into an end of the cable 10 around the dielectric 16 and under the drawn back conductive shield 14 and protective outer jacket 12 thereof. When the cable is inserted, the pulled back conductive shield 14 may contact surfaces of the post 30 and the connector body 70. Thus, where the post 30 or connector body 70 is formed of conductive material, or where the components are embodied in a integral connector body 90 structure formed of conductive material, an electrical connection may be formed facilitating a ground through the compression connector 100. Where, an embodiment of compression connector 100 does not included a post or post member, the conductive shield 14 of coaxial cable 10 may make physical and/or electrical contact with the interior surface of the central axial bore 114 of connector body 110. Moreover, when the cable is inserted, the exposed center conductor 18 may extend axially into the hand installable compression connector 100 being substantially encompassed by the connector body 70, outer casing, shell or compression sleeve 40 and/or post 30 and/or threaded nut 50.

An additional method step for coupling the compression connector 100 to a coaxial cable 10 may involve securing the hand installable compression connector 100 to the coaxial cable 10. Reaction forces applied (by hand or hard surface or the like) to the outer casing, shell or sleeve 40 may cause the compression sleeve 40 to slidably move over the connector body 70. As the outer casing, shell or sleeve 40 is slid over the connector body 70, the fastener member 60 may correspondingly slide along the exterior surface of the closeable fingers 72 drawing them inward into engagement with the protective outer jacket 12 of the coaxial cable 10. Slidable movement may continue until the fastener member 60 moves to a final position in the shallow exterior recess surface feature 74 formed on the closeable fingers 72 thus retaining the fastener member 60 (a ring in one embodiment) in a mechanically secured second position 202. Interior surface features 76, such as axial serrations, formed on the closeable fingers 72 may provide secure contact with the prepared coaxial cable 10. When the fastener member 60 is positioned, snapped, locked or located within the shallow exterior recess surface feature 74 formed on the closeable rings 72 of the connector body 70, axial movement of the fastener member 60 with respect to the connector body 70 is hindered in both directions thereby rendering secure axial placement of the fastener member 60 with respect to the connector body 70. Because the closeable fingers 72 of the connector body 70 securely engage the coaxial cable 10 when compressed into a closed position 79 and because the connector body is maintained in a mechanically secured axial position, the coaxial cable 10 is likewise secured axially within the connector 100.

With further reference to FIGS. 1-6, when the coaxial cable 10 is coupled to and terminally installed in the compression connector 100, the outer casing, shell or compression sleeve 40 and threaded nut 50 may be free to spin axially with respect to the rotationally secured coaxial cable 10, post 30, fastener member 60 and connector body 70. The outer casing, shell or sleeve 40 and corresponding exterior surface features 44 such as textured grooves formed on the exterior surface of the outer compression sleeve 40 may act as a gripping surface. Hence a person who is installing the connector 100 may use their hands and fingers or gripping tools if available to engage the threaded nut 50 and thereby tighten the compression connector 100 and attached coaxial cable 10 onto a coaxial cable interface port 20 comprising a threaded exterior surface 24. As the person turns the outer casing, shell or compression sleeve 40 and engages threaded nut 50, the compression connector 100 advances onto the coaxial cable interface port 20 and the center conductor 18 of the coaxial cable 10 moves into the conductive receptacle 22 of the coaxial cable interface port 20 thereby forming an electrical connection. The free spinning rotation of the outer casing, shell or sleeve 40 and threaded nut 50 allows the compression connector 100 to be threaded onto a coaxial cable interface port 20 while maintaining the securely connected coaxial cable 10 in a rotationally static position. Because an embodiment of the compression connector 100 may be threaded onto a coaxial cable interface port 20, the electrical connection between the compression connector 100 and the interface port 20 may be mechanically rather than frictionally secured thereby maintaining a firm electrical connection. However, those in the art should recognize that other embodiments of the compression connector may involve push-on rather than thread-on advancement of the compression connector 100. For example, compression connector 100 may be configured with a push-on-type first end 91 such that the connector 100 may be advanced over the outer surface 24 of an interface port 20 and maintained in a secure position through frictional contact with an internal surface 97 of the compression connector 100.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. A connector for coupling an end of a coaxial cable, the coaxial cable having a center conductor surrounded by a dielectric, the dielectric being surrounded by a conductive shield and a protective outer jacket, said connector comprising:

a connector body having a first end and a second end, the second end having a plurality of closeable fingers for receiving the coaxial cable, said plurality of closeable fingers an open position and a closed position; and a compression sleeve slidably mounted on said first end of the connector body in a first initially assembled position wherein the plurality of closeable fingers are in the open position and wherein the closeable fingers are located outside of the compression sleeve and extend axially away from the compression sleeve, such that when the compression sleeve is moved to a second position the compression sleeve extends over and substantially covers said closeable fingers, causing the closeable fingers to compress into a closed position securely engaging the coaxial cable.

2. The connector of claim 1 further comprising a post where said connector body is operatively positioned with respect to said post, said post being configured to be inserted into an end of the coaxial cable around the dielectric and under the protective outer jacket thereof.

3. The connector of claim 1 further comprising a threaded nut for securely coupling said connector to a coaxial cable interface port, wherein said nut comprises at least one axially directional slot upon an exterior surface of said nut.

4. The connector in claim 3 further comprising a fastener member operating with said compression sleeve and slidably mounted with said compression sleeve on said connector body.

5. The connector in claim 4 wherein at least one of said connector body and said fastener member includes a surface feature to secure axial movement in both directions of said fastener member with respect to said connector body.

6. A method for coupling a connector and a coaxial cable, said method comprising:

preparing a coaxial cable;

providing a hand installable compression connector in a first initially assembled position, said compression connector including a connector body having a first end and an opposing second end, said second end having a plurality of closeable fingers included thereon and extending outward from said first end;

inserting the coaxial cable into the connector by initially passing the coaxial cable though said second end of the connector body while said closeable fingers remain positioned outside of the outer compression sleeve; and, securing the connector by hand to the cable by moving the outer compression sleeve in cooperation with the fastener member such that the compression sleeve extends over and substantially covers the closeable fingers thereby compressing said closeable fingers of the connector body against the cable to retain the cable axially when the fastener member moves into a final mechanically secured position.

7. The method of claim 6 wherein said providing the hand installable compression connector in a first initially assembled position further includes the insertion of a threaded nut into an end of an outer compression sleeve opposite an end of said sleeve wherein the connector body and a fastener member have been slidably inserted until a threaded nut abuts an edge of the connector body.

8. The method of claim 7 wherein the provision of a hand installable compression connector in a first initially assembled position further comprises axial insertion of a post into an outer compression sleeve until a flange of said post abuts a lip of the threaded nut and a ridge of the post abuts an inserted edge of the connector body.

9. The method of claim 6 wherein the step of inserting the coaxial cable into the connector further comprises maneuvering the prepared coaxial cable such that a post is positioned into an end of the cable around the dielectric and under the drawn back conductive shield and protective outer jacket thereof.

10. A connector for coupling an end of a coaxial cable, the coaxial cable having a center conductor surrounded by a dielectric, the dielectric being surrounded by a conductive shield and a protective outer jacket, said connector comprising:

a connector body having a first end and a second end, the second end having a plurality of closeable fingers for receiving the coaxial cable, said plurality of closeable fingers having an open position and a closed position; and means for compression of said closeable fingers, said means mounted on said first end of the connector body in a first position wherein the plurality of closeable fingers are in the open position and wherein the closeable fingers are located outside of said means and extend axially away from said means, such that when said compression means is moved to a second position said means extends over and substantially covers said closeable fingers, causing the closeable fingers to compress into a closed position securely engaging the coaxial cable.

* * * * *

UNITED STATES PATENT AND TRADEMARK OFFICE

CERTIFICATE OF CORRECTION

Figure 2A:
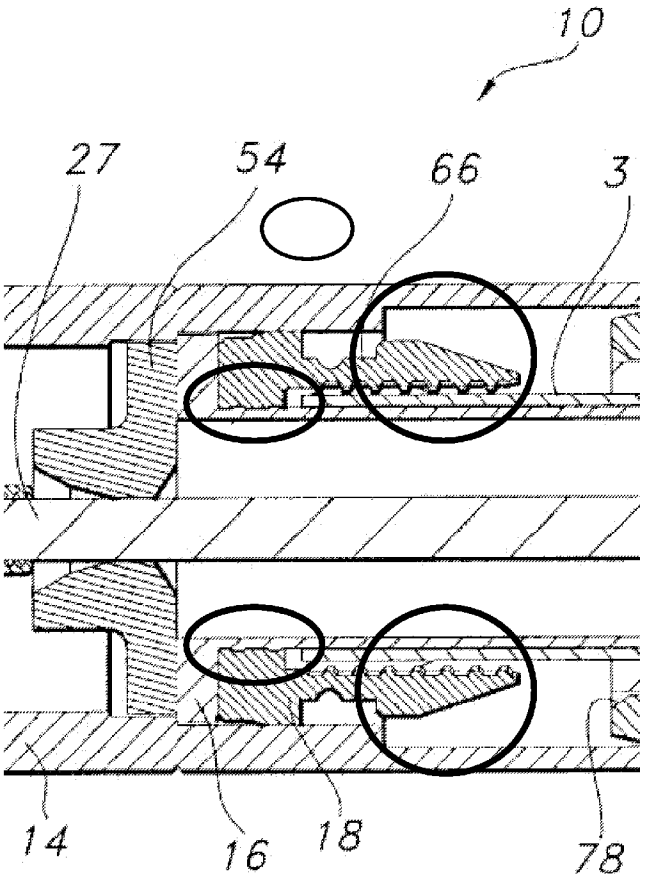

PATENT NO. : 7,300,309 B2
APPLICATION NO. : 11/424646
DATED : November 27, 2007
INVENTOR(S) : Montena It is certified that error appears in the above-identified patent and that said Letters Patent is hereby corrected as shown below:

Drawing Sheet 3, FIG 2A
Delete this sheet from the patent

Column 6
Line 44, delete “difference” and insert -- different --

Column 8
Line 27, delete “farther” and insert -- further --

Signed and Sealed this

Twenty-ninth Day of April, 2008

JON W. DUDAS
*Director of the United States Patent and Trademark Office*